US005183430A

United States Patent [19]

Swann

[11] Patent Number: 5,183,430

[45] Date of Patent: Feb. 2, 1993

[54] GEOMETRIC TOY CONSTRUCTION SYSTEM

[76] Inventor: James Swann, 7347 S. Paxton, Chicago, Ill. 60649

[21] Appl. No.: 328,932

[22] Filed: Mar. 27, 1989

Related U.S. Application Data

[63] Continuation-in-part of Ser. No. 856,366, Apr. 28, 1986, abandoned.

[51] Int. Cl.[5] ..... A63H 33/08

[52] U.S. Cl. ..... 446/104; 446/111; 446/115

[58] Field of Search ..... 446/108, 104, 102, 115, 446/116, 114, 120, 121, 124, 122, 126, 111; 52/81, 594

[56] References Cited

U.S. PATENT DOCUMENTS

| | | | |
|---|---|---|---|
| 2,208,049 | 7/1940 | Pajeau | 446/102 |
| 2,414,716 | 1/1947 | Carson | 446/112 |
| 2,776,521 | 1/1957 | Zimmerman | 446/115 |
| 2,786,301 | 3/1957 | Torricelli | 446/115 |
| 3,086,629 | 4/1963 | Blitzer | 52/594 X |
| 3,442,044 | 5/1969 | Quercetti | 446/124 |
| 3,597,874 | 8/1971 | Ogsbury | 446/104 |
| 3,648,404 | 3/1972 | Ogsbury et al. | 446/126 |
| 4,147,007 | 4/1979 | Eppich | 446/114 |
| 4,253,268 | 3/1981 | Mayr | 446/104 |
| 4,309,852 | 1/1982 | Stolpin | 52/81 |

FOREIGN PATENT DOCUMENTS

| | | | |
|---|---|---|---|
| 121402 | 5/1946 | Australia | 446/124 |
| 1218291 | 5/1960 | France | 446/124 |
| 271971 | 2/1951 | Switzerland | 446/104 |
| 2072521 | 10/1981 | United Kingdom | 446/124 |

OTHER PUBLICATIONS

EPO 0,109,181 May 23, 1984, John Inskip.

*Primary Examiner*—Mickey Yu

*Attorney, Agent, or Firm*—Jerry A. Schulman

[57] ABSTRACT

A geometric toy construction system has a multiplicity of flat, polyagonal construction pieces interengageable edge-to-edge to form two- and three- dimensional constructions. The edgewise connectors enable the pieces to be snap-fit together and to rotate about the axis of interconnection. The connector sets are formed to allow four or more individual pieces to be snap-fit about a common axis. Attachment sites are also formed along the construction pieces, preferably at the corners thereof, to accomodate flexable connecting pipes in a friction-fit for corner-to-corner or apex-to-apex connection. Similarly, a soft, pliable ball member may be substituted for the pipe into which the connecting sites may be pressed. Elastic bands may also be secured between attachment sites to hold the construction together. The construction pieces may be color coded to indicate the edge size, size of the connector sets or selected types of pieces.

26 Claims, 7 Drawing Sheets

FIG. 35
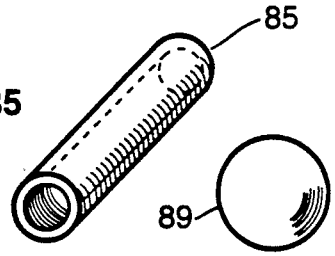
FIG. 36
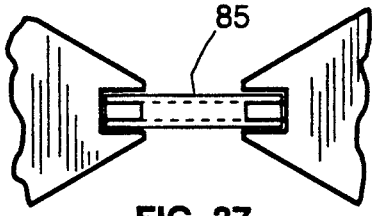
FIG. 37
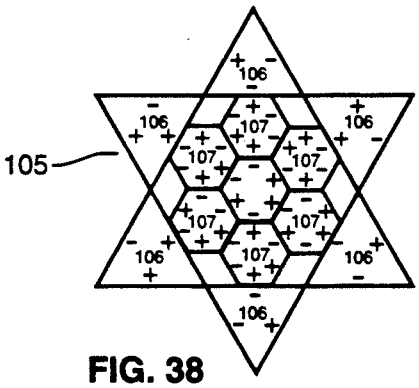
FIG. 38
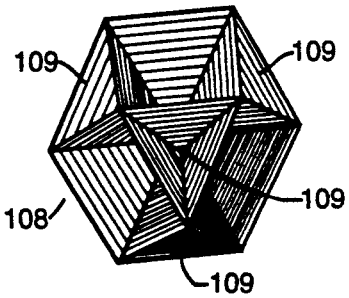
FIG. 39
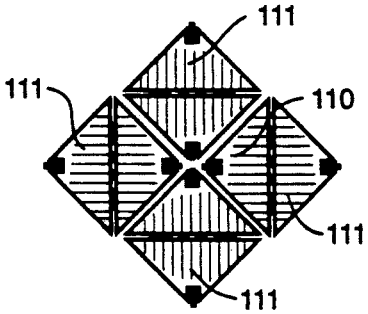
FIG. 40
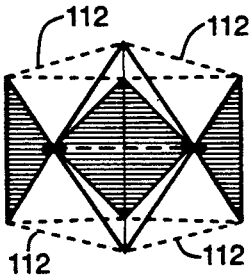
FIG. 41
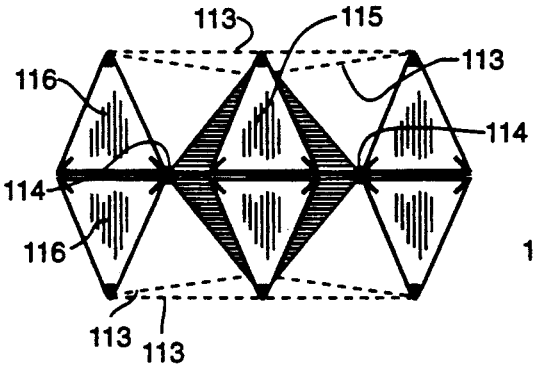
FIG. 42
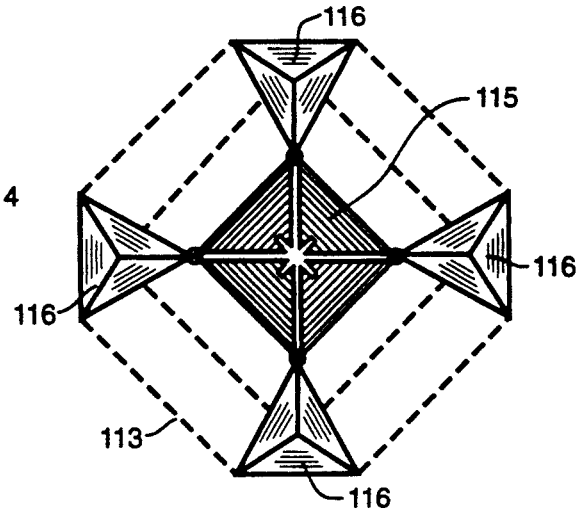
FIG. 43

GEOMETRIC TOY CONSTRUCTION SYSTEM

This is a continuation-in-part of application Ser. No. 07/856,366, filed Apr. 28, 1986 and now abandoned.

BACKGROUND OF THE INVENTION

This invention relates generally to geometric toy construction systems and, more particularly, to a system including planar geometric pieces of selected shapes having interconnection elements formed edgewise about the periphery thereof, enabling the pieces to be formed into two- and three-dimensional arrays. Connectors are also provided to allow for apical, lateral and face-to-face interconnection.

There are numerous prior art construction systems intended to enable the construction of three-dimensional figures using a variety of uniquely shaped and configured building elements. Many of these systems have been created and marketed as toys for amusement and educational purposes, intended to make use of basic principles of construction and geometry to "teach" construction principles in a diverting and amusing fashion. Well-known systems such as those sold under the trademarks TINKERTOY, ERECTOR, CONSTRUX, LEGO, DUPLO and CAPSELA characterize the types of construction systems presently commercially available. All of the foregoing construction systems utilize specifically designed and configured pieces which may be interconnected to produce various structures. The configurational properties of these individual pieces require that many specialized shapes and connectors be used in order to make free-form construction possible. While such systems are well-engineered, well-made, and easy to use, it is believed that such systems do not teach the use of basic planar shapes to construct three-dimensional objects, nor are they capable of simulating most regular geometric polyhedral shapes.

The principles behind the use of such planar shapes occur naturally in, for example, the molecular structure of chemical compounds and crystals. Use of such shapes in an educational setting helps the user to develop a "feel" for naturally occurring structures. As Albert Einstein once observed: "Pure logical thinking cannot yield us any knowledge of the empirical world; all knowledge of reality starts from experience and ends in it." By creating a sense of how planar shapes and spaces interact to form three-dimensional systems, the groundwork is laid to more meaningfully explain to a user how atoms arrange themselves in space to form molecules, or how planar building panels may be utilized to create a well-designed and attractive living space. There have been prior efforts by others to create and design such planar building systems. For example, U.S. Pat. Nos. 4,090,322 (Hake); 4,065,220 (Ruga) 4,055,019 (Harvey); 2,776,521 (Zimmerman); 4,309,852 (Stolpin); 2,414,716 (Carson); 2,786,301 (Torricelli); 4,147,007 (Eppich); 4,253,268 (Mayr); 2,208,049 (Pajeau); and 3,442,044 (Ouercetti), and such as Australian Patent 121,402 (Kuna); Swiss Patent 568,086 (Wyss); U.K. Patent Application 2,072,521 (Squibbs); French Patent 1,218,291 (Pasky) and European Patent Application 0,109,181 (Inskip) all teach systems of planar shapes which are, in one fashion or another, interconnectable.

Hake utilizes generally triangular-shaped elements with each shape having either a male connector, a female connector, or one male and one female connector fashioned thereon. The inability to connect along all edges of the individual pieces limits the type of three-dimensional expressions possible with such a construction. Ruga teaches a series of generally hexagonal planar shapes with grooves formed peripherally about each shape. The shapes may be interconnected by interengaging grooves of individual planar elements or through use of cylindrical connecting elements engageable in a pair of such grooves. The Ruga system is limited by the central angles available and is not designed for polyhedron planar construction shapes.

The Harvey reference shows flat planar pieces of varying geometric configurations connectable in edgewise fashion through use of connectors, with each connector having a male portion and a female portion. In like fashion, Zimmerman teaches a generally triangular construction element having connectors formed edgewise with both male and female elements included on the same edge. Inskip teaches edgewise connections of planar pieces. Harvey, Zimmerman. Stolpin and Mayr lack the capability for further interconnection other than by the indicated edgewise hinge connectors, and are believed to be more limited than the construction which is the subject of the present invention. Inskip also teaches planar shapes with edgewise connectors. None of the above provide for three and four way edge hinging or for stabilizing such constructions.

Also of interest are U.S. Pat. Nos. 3,777,393 (Baer) and 3,624,955 (Matsubayashi), both of which teach systems for the face-to-face interconnection of construction elements. U.S. Pat. Nos. 3,921,312 (Fuller) and 3,819,188 (Freedman) teach planar educational constructions featuring edgewise connection but lacking the simplicity and basicity, and thus the teaching and experiential potential of the present invention. U.S. Pat. No. 3,577,660 (Kenney) teaches and describes a system for the construction of molecular models consisting of planar shapes interconnectable via tubular connectors to approximate the three-dimensional structures of chemical molecules. Such structures are not true three-dimensional depictions of the naturally occurring chemical molecules.

BRIEF DESCRIPTION OF THE INVENTION

The following definitions will be used throughout the following descriptions:

Apex: the point at which two edges of a planar polygon meet.

Vertex: the point where three or more edges of a polyhendron meet.

Single Bonding: the joining of two polyhedrons vertex-to-vertex.

Double Bonding: the connecting of two polyhedrons edge-to-edge, accomplished by interconnecting the edges of four polygons about a single axis.

Triple Bonding: the joining of two polyhedrons face to face where the polyhedrons share a planar piece as a common face and where each edge of the common face polygon engages the edge of one polygon from each polyhedron plus an edge from the common face, forming three way engagement at all edge of the common face polygon.

Single and Double Frequency: first- and second-group pieces with standard edge lengths are termed single-frequency; those with edge lengths twice the standard length are double-frequency.

A series of planar polygons has edgewise connecting elements forming connectors peripherally thereabout with one such connector comprising an arm upon which protruding curvilinear surfaces, or "balls", are formed (hereinafter a "plus" connector), and a second such connector comprising a protruding arm within which sockets are formed (hereinafter a "minus" connector), with the sockets corresponding in size and shape to the protruding balls on the plus connectors.

In a preferred embodiment, two groups of planar, straight-edged polygons, identical in size and shape, have the sockets along the edge of one polygon designed to nest with the balls along the edge of another polygon producing hinges allowing rotation of two, three, four or more polygons about their mutually interengaged edges. More specifically:

(1) The first group of polygons has one pair, or "set" of like connectors symmetrically positioned on each edge such that when two polygons are engaged, one pair of hinges is formed, with each hinge having one minus connector and one plus connector.

(2) The second group of polygons has at least two sets of like connectors on each edge, such that when two second group polygons are interengaged, one pair of hinges is formed, with each hinge having one minus connector and one plus connector. The second set of connectors on each edge remains free for selective interengagement with first-group polygons.

(3) When two second-group polygons are interengaged, there remains an unoccupied set of plus connectors on one polygon which will engage with one set of minus connectors on a first-group polygon. In like manner, there remains an unoccupied set of minus connectors on the other polygon, positioned such that it will engage with one set of plus connectors on a first-group polygon.

(4) Two first-group polygons may be engaged to each other and with any edge of a second-group polygon containing an unoccupied plus connector set. A pair of three-part hinges will thus be formed, with each hinge having two plus connectors and one minus connector. In like manner, a second-group polygon with an unoccupied minus connector set may engage with two first-group polygons, producing a pair of three part hinges, with each hinge comprised of two minus connectors and one plus connector. In either case, one plus set or one minus set of connectors remains unoccupied.

(5) Two second-group polygons may be engaged to a polygon from the first group, with an edge containing either a set of plus or minus connectors. Two pairs of two-part hinges are formed, and either one plus pair of connectors or one minus pair of connectors from the second-group of polygons remains unoccupied.

(6) Two first-group polygons and two second-group polygons may be engaged utilizing all plus and minus connectors sets. This final engagement produces one pair of four part hinges and one pair of two part hinges, with the four polygons hinged about a common axis.

A third group of polygons could be constructed using the same sequential hinging arrangement described above for groups one and two, to engage the two outermost pair of hinges of any second-group polygons to provide for five- and six-way hinging of two polygons from each of the three groups.

The same hinging options and results as herein described can be achieved when the two outermost hinge pairs from a second-group polygon are engaged with the outermost plus hinge pair of a first-group polygon and the innermost minus pair of the second-group polygon is omitted. This arrangement, when four polygons are engaged about their mutually interfaced edge, produces a pair of five part hinges, and is present when double bonding occurs.

The polygon shapes are selected to comprise basic building elements from which other planar and three-dimensional structures may be assembled. A preferred selection of basic planar shapes includes (1) a pair of equilateral triangles, with one member of the pair having two plus connectors, or a plus connector "set" formed symmetrically about each of two edges and the remaining edge having two minus connectors, or a minus connector "set" formed symmetrically thereon, the second member of the pair having one plus connector set and two minus connector sets formed thereon; (2) a pair of right isosceles triangles with a set of plus connectors formed on one leg and the hypotenuse and a set of minus connectors formed on the remaining leg, while the second pair member has a set of plus connectors formed on one leg and a set of minus connectors formed on the hypotenuse and the remaining leg; and (3) a pair of isosceles triangles having apex angles of 70° 32′ and base angles of 54° 44′, with the first member of the pair having one "plus" leg and one "minus" leg, with a "plus" base, while the second number of the pair has one "plus" leg, one "minus" leg and a "minus" base; a pair of isosceles triangles having an apex angle of 109° 28′ and a pair of base angles of 35° 16′, with one member having a plus leg, a minus leg and a plus base while the remaining member of the pair has a plus leg, a minus leg and a minus base.

All identically edged and faced triangles come in pairs with complementary connector sets, i.e., one triangle with two plus and one minus and the other with one plus and two minus. With equilateral triangles, edge location of minus and plus sets is arbitrary. With isosceles triangles the two equal edges preferably have a plus connector set on one equal edge and a minus connector set on the other equal edge, and the odd edge will have a plus set on one of the complementary triangles and a minus set on the other. All symmetrically-arranged minus and plus edge connector sets are positioned to hinge with other like sets on other polygons when their mutual edges are of equal length. They may also be arranged to hinge with polygons where the edges of said polygons are one-third (⅓) the length of the joining edges.

All other polygons in this set beyond the basic triangles heretofor described are derived from those triangles, i.e., the square, the diamond, the pentagon, the hexagon, etc., and can be construed from two or more of the basic triangles. For simplicity and variety, however, those additional polygons are included as separate pieces. Regular polygons having an even number of sides will not require a complementary mate, but all having an odd number of edges will require a complement, i.e., diamonds, squares and hexagons will not require mates but pentagons will. Some of these polygons, as noted in the prior paragraph, may be provided at ⅓ standard edge size. Also note that with these polygons more connector options are available. For example, with squares and diamonds, two arrangements are possible; like connectors sets may be either on opposite or adjacent edges. For the preferred embodiment presented herein, one option only has been selected. Finally, it should be noted that all of these planar polygons are mirror-image reversible.

It is also contemplated that certain of the planar shapes shall have one or more matching major dimensions to enable interconnectability along edges of the same length. As an example, if the equilateral triangles described above have an edge equalling "a" in length, then it is contemplated that a first pair of right isosceles triangles may be provided with a hypotenuse length of "a" and with leg lengths of $$\frac{a\sqrt{2}}{2}.$$

A second pair of right isosceles triangles maybe provided having leg dimensions of "a" and a hypotenuse dimension of $a\sqrt{2}$. In like fashion, for the remaining isosceles triangles described hereinabove, the isosceles triangles having an apex angle of 70° 32 min. would have legs $$\frac{a\sqrt{3}}{2}$$

in length and a base "a" in length, while the isosceles triangle having an apex angle of 109° 28 min. would have legs $$\frac{a\sqrt{6}}{4}$$

in length and a base of "a" in length.

Each such planar shape will preferably include a plurality of slotted connecting sites formed thereon. For the triangular planar shapes, it is preferred that the connecting sites be formed at the three apices of the triangle. With respect to square shapes, it is contemplated that such interconnecting sites may be formed at the corners of the square. These connecting sites provide for additional construction possibilities: (1) a central cylindrical tongue positioned between slots formed at each site designed to receive short flexible connecting pipes will allow single polygons to be joined apex-to-apex or corner-to-corner, allowing for the construction of open-faced polyhedra and collapsible polyhedra; and (2) two or more closed-faced polyhedra can be interfaced vertex to vertex by pipes inserted into the apex (or corner) tongues of the interfaced polygons. In this manner, polyhedra may be joined in single-bond i.e., apex to apex, and many polyhedra can be joined in single-bonded arrays.

Connecting pins and corresponding connecting sockets may also be formed along the faces of the planar elements to enable face-to-face interconnection, when desired. Said face-to-face interconnection may be done in overlapping fashion, where similar shapes have corresponding edges arranged parallel one to the other, or in skewed or rotated fashion.

The shapes are preferably injection-molded from polypropylene or another, equally flexible thermoplastic material to allow for each interconnection while maintaining a desired rigidity. The flexible connecting pipes are fashioned from material such as polypropylene, or rubber.

These above-described shapes could be made on a much larger scale such that they could be assembled into shelters and miscellaneous play shapes for small children, and into constructions such as display booths.

BRIEF DESCRIPTION OF THE DRAWINGS

These, and further aspects of the present invention will become more apparent upon consideration of the accompanying drawings, wherein:

FIG. 3 is a plan view of a right isosceles triangular construction piece having two plus and one minus edgewise connector sets and a standard hypotenuse length a;

FIG. 5 is a plan view of a right isosceles triangular construction piece having two plus and one minus connector sets and a standard leg length a;

FIG. 35 is an enlarged partial perspective view of a flexible connecting pipe;

FIG. 36 is a perspective view of connecting ball;

FIG. 37 is a partial plan view showing two apical connecting sites joined by a connecting pipe;

FIG. 38 is a two dimensional pattern construction consisting of six standard equilateral triangles and six small (⅓ edge size) hexagons indicating plus and minus connector arrangements;

FIG. 39 is a double bonded concave cubaoctahedron consisting of four first-group regular equilateral tetrahedrons and four second-group equilateral tetrahedrons with extended connector sets (the outer surface face of each tetra has been omitted);

FIG. 40 is a top view of a double bonded and flexibly banded array consisting of one central second-group octahedron and four regular first-group tetras;

FIG. 41 is an elevational view of the construction of FIG. 40;

FIG. 42 is a lateral view of a single bonded array consisting of one central octahedron and eight triple bonded double tetras all held together with flexible banding;

FIG. 43 is a top view of the construction of FIG. 42;

DETAILED DESCRIPTION OF THE DRAWINGS

Figure 1:
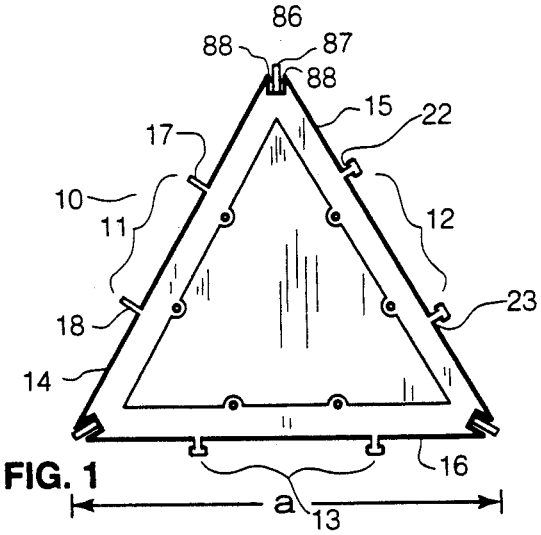
FIG. 1 is a plan view of a planar triangular construction piece having two plus and one minus edgewise connector sets and a standard edge length.

Referring now to FIG. 1, the numeral 10 indicates generally a planar, polygonal construction piece embodying many of the operative features of the present invention. It is contemplated that each of the shapes in question will be injection molded using a plastic such as polypropylene, which will allow for precise detailing and close tolerances of the interconnecting members to be described hereinbelow, as well as providing the necessary flexibility for linking pieces.

Piece 10 presents an embodiment of the present invention in the shape of an equilateral triangle. For the purposes of this application, we will consider the edgewise dimension of the equilateral triangle shown in FIG. 1 to be represented by the letter "a". In a preferred embodiment of the invention, "a" is nominally 4½ inches.

Figure 17:
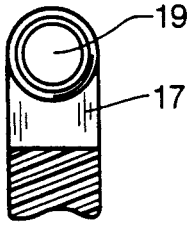
FIG. 17 is an elevation of a minus connector.
Figure 18:
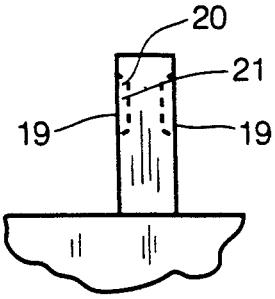
FIG. 18 is a lateral elevation of the connector shown in FIG. 17.

Piece 10 has connector sets 11, 12 and 13 formed along, respectively, edges 14, 15 and 16, with each said connector set centered or symmetrically placed on its respective edge. Referring more particularly to connector set 11, said connector set is formed as a pair of outwardly extending arms 17 and 18. As best seen in FIGS. 17 and 18, arm 17 has sockets 19 formed therein, with each socket 19 having a tapered sidewall 20 and a flattened bottom 21. In like fashion, arm 18 has identical sockets formed therein.

Figure 15:
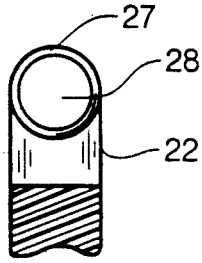
FIG. 15 is an enlarged front elevation of a single plus connector.
Figure 16:
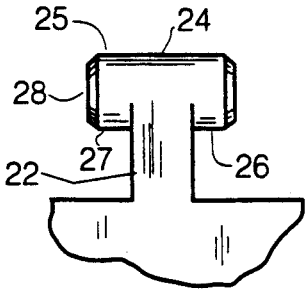
FIG. 16 is a lateral elevation of the connector shown in FIG. 15.

Referring again to FIG. 1, connector set 12 is shown having a pair of arms 22 and 23 extending outwardly from piece 10. As best seen in FIGS. 15 and 16, arm 22 forms the base of a generally T-shaped structure, with cross member 24 fashioned integral with arm 22 and having protruberances or "balls" 25 and 26 extending to either side of arm 22. In a preferred embodiment, each such ball 25 and 26 is molded to conform in shape to socket 19. In the embodiment shown in FIG. 16, ball 25 has a sloping shoulder 27 and a flat face 28 to correspond, generally with sidewall 20 and bottom 21.

As herein contemplated, each connector set 11 and 12 will include two arms, with both arms in a single set having either the socket or ball configuration. For purposes of describing the present invention, we will refer throughout to a connector set having a pair of T-shaped arms to be a "plus" set and a connector having a pair of sockets formed therein to be a "minus" set. Thus, as shown in FIG. 1, connector set 11 is a minus set and connector set 12 is a plus set.

The designation of the connector sets as described hereabove is arbitrary, and any terms indicating that two complementary and coacting connector sets are used would be acceptable.

Figure 19:
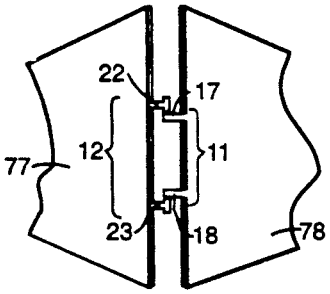
FIG. 19 is a partial elevation of two first-group polygons showing the interconnection of a plus connector set and a minus connector set to form a pair of two-part hinges joining two polygons.

As seen in FIG. 19, plus connector set 12 and minus connector set 11 are configured to allow the manual frictional interengagement and disengagement of pieces 77 and 78, by inserting protruberances 26 into sockets 19. Thus, any planar piece in the present invention may be interengaged with any other planar piece having the same edgewise dimension in an edgewise orientation by the mating set of a corresponding plus or minus connector set.

It is a significant aspect of the present invention that the planar pieces are provided with different configurations of connector sets. As an example, in FIG. 1, planar triangle 10 has two plus connector sets and one minus connector set positioned along the edges of the triangle, while in FIG. 2 planar equilateral triangle 10' has two minus connector sets 11' formed on sides 14' and 16' and one plus connector set 12' formed on side 15'.

Figure 3:
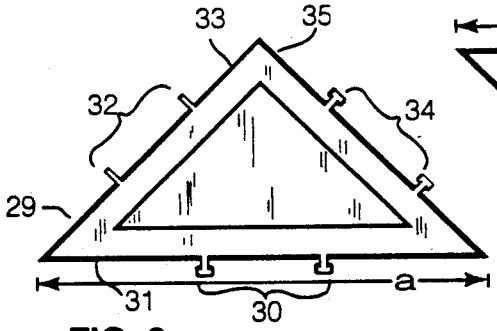
Figure 4:
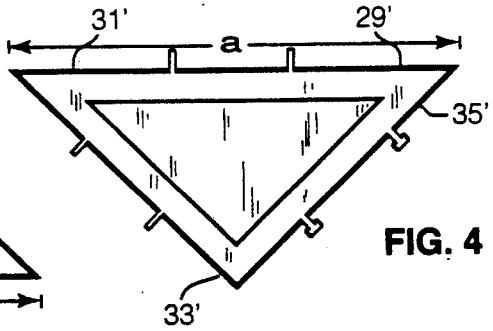
FIG. 4 is a plan view of a piece complementary to that of FIG. 3 having one plus and two minus connector sets.

Varying the shapes of the planar pieces also creates possibilities of differing connector set configurations. In FIG. 3, for example, a right isosceles triangular planar piece 29 has a plus connector set 30 formed along hypotenuse 31, a minus connector set 32 formed along leg 33, and a plus connector set 34 formed along leg 35. In FIG. 4, a complementary, identically dimensioned and configured right isosceles triangle 29' has a minus connector set formed along hypotenuse 31', a minus connector set formed along leg 33' and a plus connector set formed along leg 35'.

Figure 5:
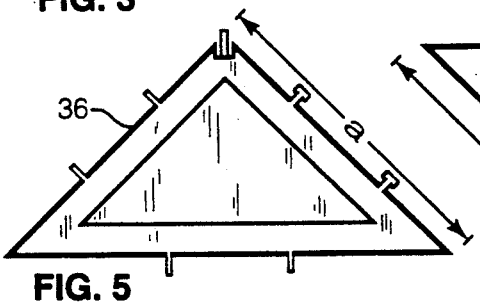
Figure 6:
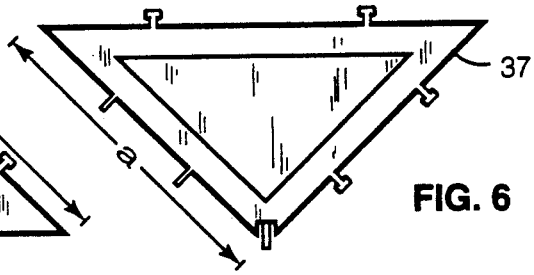
FIG. 6 is a plan view of a complementary piece to that of FIG. 5 having one plus and two minus connector sets.

Another configurational variation is exemplified in FIGS. 5 and 6 along with FIGS. 3 and 4. In FIGS. 3 and 4, for example, standard edgewise dimension "a" forms the hypotenuse of triangular shapes 30 and 30', with each leg of said triangle having a dimension equal to a/2. In FIGS. 5 and 6, complementary right isosceles triangles 36 and 37 are provided having a leg dimension equal to "a" and a hypotenuse dimension equal to $$\frac{a/2}{2}.$$

Figure 7:
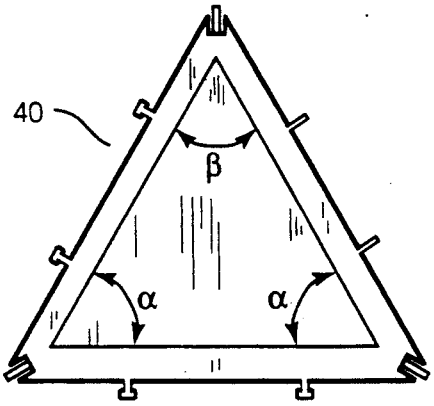
FIG. 7 is a plan view of an isosceles triangular planar piece having an apex angle of 70° 32′ and having one plus and two minus connector sets.
Figure 8:
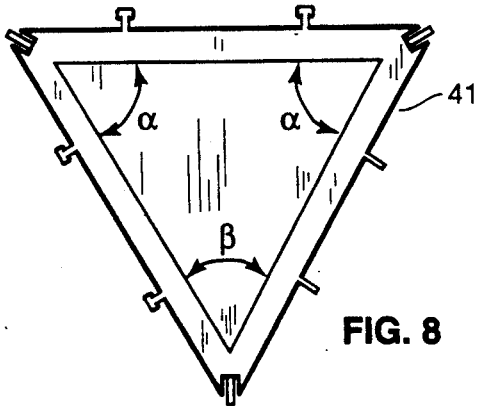
FIG. 8 is a plan view of a complementary piece to that of FIG. 7 having two plus and one minus connector sets.

Other confirgurational and dimensional variations may be illustrated by FIG. 7, where an isosceles triangular piece 40 has base angles alpha of 54° 44' and an apex angle beta of 70° 32' resulting in a dimensional configurations of "a" for the base and $$\frac{a\,3}{2}$$

for the remaining sides. A minus connector set is formed along the base and one leg, and a plus connector set is formed along the remaining leg. In FIG. 8, a complementary isosceles triangular piece 41 has plus connector sets along the base and one leg, and a minus connector set formed along the remaining leg.

Figure 9:
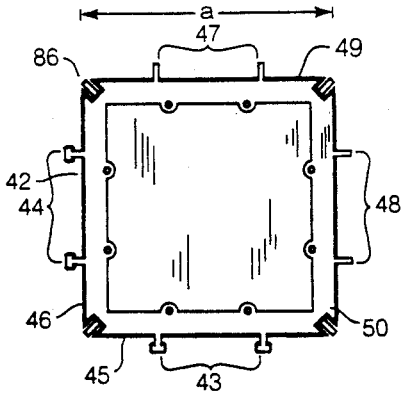
FIG. 9 is a plan view of a square planar construction piece having two plus and two minus connector sets.

Referring now to FIG. 9, a flat planar piece in the shape of square 42 is shown, having an edgewise dimension of "a". The configuration shown in FIG. 9 has plus connector sets 43 and 44 positioned along contiguous edges 45 and 46, and minus connector sets 47 and 48 positioned along contiguous edges 49 and 50. A second selected configuration utilizing square 42, not herein specifically shown, has a pair of plus connector sets positioned along the edges of opposite edges, such as edges 45 and 49, with the remaining two edges of the square having minus connector sets, such as at edges 42 and 46. If desired, a square piece may have plus connectors formed along the edges of all edges, minus connectors formed along the edges of all edges, or a configuration featuring three edges having plus connectors and one edge having a minus connector set or three edges having minus connector sets and one edge having a plus connector set. It should be noted throughout that whenever such variations in the positioning and character of connector sets is discussed, it should be readily apparent that different configurational and construction options are provided by the availability of connector sets to be mated with complementary connector sets formed on other construction pieces.

Figure 10:
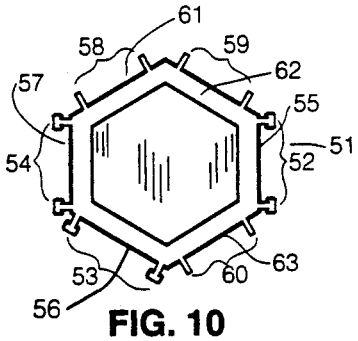
FIG. 10 is a plan view of a hexagonal planar construction piece having three plus and three minus connector sets.

Referring now to FIG. 10, the numeral 51 indicates generally a flat, planar, hexagonal piece. In the embodiment herein shown, hexagonal piece 51 has plus connections sets 52, 53 and 54 formed along edges 55, 56 and 57, with minus connector sets 58, 59 and 60 formed, respectively, along edges 61, 62 and 63. The piece shown is a regular hexagon with equal edges measuring ⅓ a, and is provided with standard connectors which allow it to hinge with "a"—dimensioned edges of other polygons. Other regular hexagons with edges of "a" length and identical connector positioning are possible. It is contemplated that, for example, various hexagonal shapes may be provided with connector sets formed along each edge and, as it may readily be appreciated, the plus/minus configurations of the connector sets on those edges could be formed in a number of various configurations. As herein contemplated, a preferred embodiment of hexagonal piece 51 would have an outer edge dimensional of "a", or ⅓A and the preferred arrangement of connectors is as shown in FIG. 10.

Figure 11:
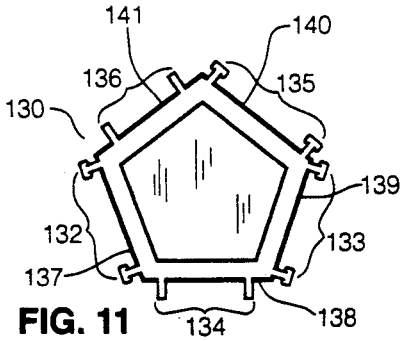
FIG. 11 is a plan view of a pentagonal planar construction piece.
Figure 12:
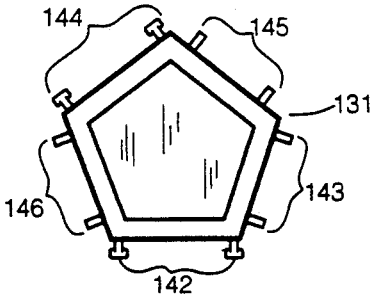
FIG. 12 is a plan view of a complementary piece to that of FIG. 11.

Referring now to FIGS. 11 and 12, the numerals 130 and 131 refer, respectively, to flat, planar pentagonal pieces. Pentagon 130 has plus connector sets 132 and 133 formed, respectively, on edges 137 and 139, and minus connector sets 134, 135 and 136 on edges 138, 140 and 141. Pentagon 131 is configured complementarily to pentagon 130, with plus connector sets 142, 143 and 144 and two minus connector sets 145 and 146 thereon.

Heretofore, the connector sets discussed in connection with FIGS. 1-12 have been positioned and configured to be a selected standard distance apart so that all plus connector sets would interconnect with all minus connector sets in a friction fit as shown in FIG. 19. For purposes of convenience, we will call this the standard connector configuration. In a preferred embodiment, the outer dimension from, for example, arm 17 to arm 18 is 1.000 inch, while the inner dimension between balls 25 and 26 as shown in FIG. 1 is 1.000 inch. This dimension will allow the interconnection of a single plus connector set with a single minus connector set along a common axis passing generally parallel to the edges of the construction pieces being joined and passing through the centers of sockets 19 and balls 25 and 26.

Figure 13:
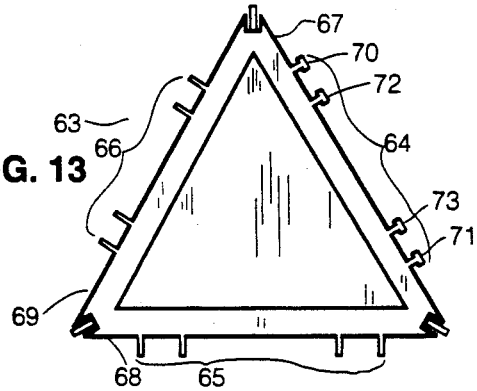
FIG. 13 is a plan view of an equilateral triangular planar construction piece having one oversized and two undersized plus connector set on one edge and similarly spaced pairs of minus connector sets on the remaining edges.
Figure 14:
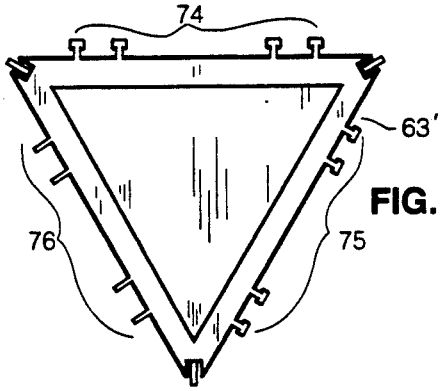
FIG. 14 is a plan view of a piece complementary piece to that of FIG. 13

Referring now to FIG. 13, there is therein shown an equilateral triangular planar piece 63 having an edge dimension "a". Triangular piece 63 has oversized and undersized plus connector set 64 and oversized minus connector sets 65 and 66 formed, respectively, along edges 67, 68 and 69. In the embodiment herein shown, oversized plus connector set 64 comprises arms 70, 71, 72 and 73 terminating in balls identical to those shown in FIGS. 15 and 16. As shown in FIG. 14, however, arms 70 and 71 are positioned a considerable distance further apart than are, for example, arms 22 and 23 of FIG. 1 while arms 72 and 73 are positioned more closely together. In the preferred embodiment herein, arms 22 and 23 are positioned a distance apart of 1.100 inch, while arms 70 and 71 are positioned a distance apart of 2.700 inches, and arms 72 and 73 are positioned a distance apart of 0.800 inches.

Oversized minus connector set 65 comprises a pair of typical connector sets such as that typified by minus connector set 11 of FIG. 1. Two such sets are positioned along a single edge of triangular piece 63 and are positioned a distance of 1.400 inch apart in a preferred embodiment. Triangular piece 63 of FIG. 13 has a pair of expanded minus connector sets 65 and 66 formed thereon, with a single set of expanded plus connectors. A complementary piece 63' is shown in FIG. 14, having two edges with oversized/undersized plus connectors 74 and 75 formed thereon, and one edge with expanded minus connector sets 76 formed thereon.

Use of oversized/undersized connector sets such as those typified in FIGS. 11 and 12 makes possible the interconnection of a plurality of construction pieces about a single axis. In order to more conveniently describe the manner in which the standard and oversized-/undersized connector sets herein may cooperate, we shall refer to FIGS. 19 through 27. Pieces having a standard plus connector set are designated 77, pieces having a standard minus connector set are designated 78, pieces having an oversized/undersized plus connector configuration are designated 79, while pieces having an oversized minus connector configuration are designated as 80.

Figure 20:
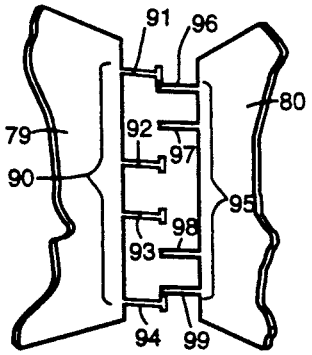
FIG. 20 is a partial elevation of two second-group polygons showing the interconnection of an oversized plus connector set and an oversized minus connector set to form a pair of two-part hinges joining two polygons.

As seen in FIG. 20, an oversized/undersized plus configuration 90 consists of plus connectors 91, 92, 93 and 94, while an oversized minus connector configuration 95 consists of minus connectors 96, 97, 98 and 99.

To interconnect pieces 77 and 78, connector 22 engages the outer socket of minus connector 17, while plus connector 23 engages the outer socket of minus connector 18, as seen in FIG. 19. FIG. 20 shows that the interconnection of pieces 79 and 80 involves the engagement of plus connector 91 and 94 with, respectively, the outer socket of minus connectors 96 and 99.

The configuration and spacing of connector sets 11, 12, 90 and allow the interconnection of pieces 77, 78, 79 and 80 as described hereinbelow.

Figure 21:
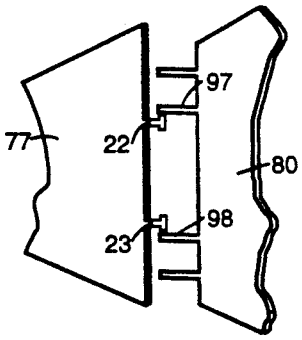
FIG. 21 is a partial elevation of a first-group polygon and a second-group polygon showing the interconnection of a standard plus connector set and an oversized minus connector set to form a pair of two-part hinges joining two polygons.

FIG. 21 shows the interconnection of pieces 77 and 80, with plus connectors 22 and 23 engaging, respectively, the inner socket of minus connectors 97 and 98.

Figure 22:
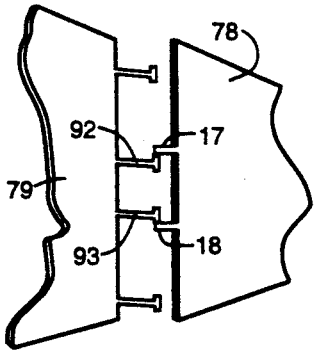
FIG. 22 is a partial elevation of a first-group polygon and a second-group polygon showing the interconnection of a standard minus connector set and an undersized plus connector set to form a pair of two-part hinges joining two polygons.

FIG. 22 shows the interconnection of pieces 78 and 79, with plus connectors 92 and 93 engaging, respectively, the inner sockets of minus connectors 17 and 18.

Figure 23:
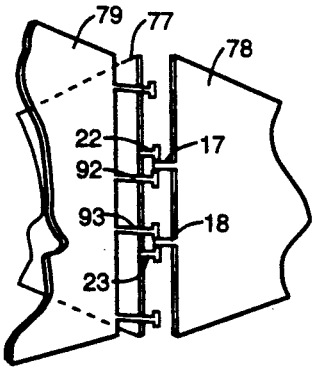
FIG. 23 is a partial elevation of two first-group polygons and a second-group polygon showing the interconnection of a standard plus connector set, a standard minus connector set and an undersized plus connector set to form a pair of three-part hinges joining three polygons about a single axis.

FIG. 23 shows the interconnection of pieces 77, 78 and 79, creating three-part hinges formed by the interconnections of plus connectors 92 and 22 with minus connector 17, and plus connectors 93 and 23 with minus connector 18.

Figure 24:
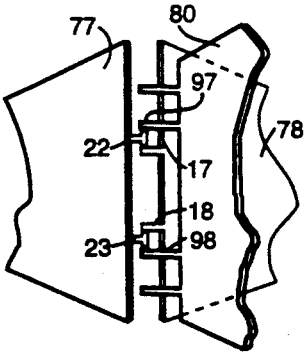
FIG. 24 is a partial elevation of two first-group polygons and a second-group polygon showing the interconnection of a standard plus connector set, a standard minus connector set and an oversized minus connector set to form a pair of three hinges joining three polygons about a single axis.

FIG. 24 shows the interconnection of pieces 77, 78 and 80, creating two three-part hinges formed by the interconnection of plus connector 22 with minus connectors 17 and 97, and the interconnection of plus connector 23 with minus connectors 18 and 98.

Figure 25:
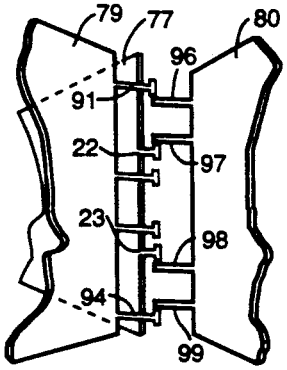
FIG. 25 is a partial elevation of one first-group and two second-group polygons showing the interconnection of one standard plus connector set, one oversized plus connector set, and two oversized minus connector sets to form four two-part hinges joining three polygons about a single axis.

FIG. 25 shows the interconnection of pieces 77, 79 and 80, with plus connectors 91, 22, 23 and 94 engaging, respectively, minus connectors 96, 97, 98 and 99.

Figure 26:
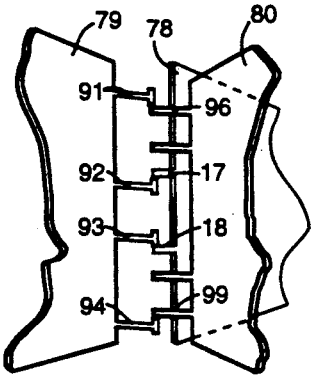
FIG. 26 is a partial elevation of one first-group polygon and two second-group polygons showing the interconnection of one standard minus connector set, two oversized and one undersized plus connector sets and one oversized minus connector set to form four two-part hinges, joining three polygons about a common axis.

FIG. 26 shows the interconnection of pieces 78, 79 and 80, with plus connectors 91, 92, 93 and 94 engaging, respectively, minus connectors 96, 17, 18 and 99.

Figure 27:
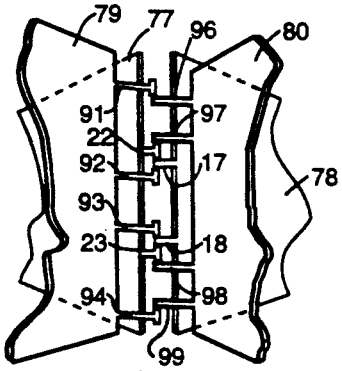
FIG. 27 is a partial elevation of two first-group polygons and two second-group polygons showing the interconnection of one standard plus connector set, one standard minus connector set, one oversized and one undersized plus connector sets and two oversized minus connector sets to form two two-part and two four-part hinges joining four polygons about a common axis.

FIG. 27 shows the interconnection of pieces 77, 78, 79 and 80, with plus connectors 91 and 94 engaging, respectively, minus connectors 96 and 99, and creating two four-piece hinges consisting of plus connectors 22 and 92 engaged with minus connectors 97 and 17, and plus connectors 93 and 23 engaged with minus connectors 18 and 98.

Figure 30:
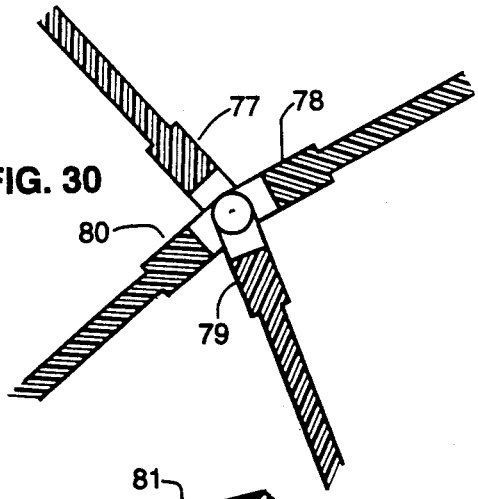
FIG. 30 is a view along 30—30 of FIG. 31, showing four planar construction elements joined about a single axis.
Figure 31:
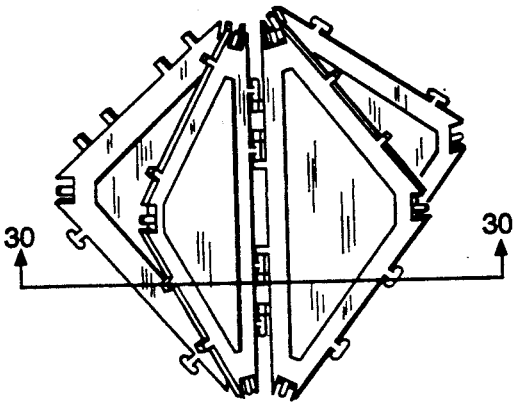
FIG. 31 is a perspective view of the construction shown in FIG. 30

FIGS. 19 through 27 illustrate the ability of the described preferred embodiment to allow the interconnection of multiple planar pieces about a common axis, while the pieces to move about the axis, as shown in FIGS. 30 and 31. In this embodiment, the plus and minus connector sets are configured such that, for example, plus connectors 22 and 23 engage the outer sockets of minus connectors 17 and 18, while plus connectors 92 and 93 are spaced to engage the inner sockets of minus connectors 17 and 18. Similarly, minus connectors 97 and 98 are spaced to engage the inner sockets of said connectors with plus connectors 22 and 23.

Other interengagement configurations are also possible, as demonstrated in FIG. 27 by the unoccupied engagement sites on connectors 91, 96, 97, 92, 93, 98, 99 and 94.

Standard sized pieces may be inter connected to form larger, planar polygons as well. For example, in FIG. 50, four equilateral triangles 130,131, 132 and 133 are inter connected to form one larger triangle 134. As shown in FIG. 51, four right isosceles triangles 140, 141, 142 and 143 can be formed into a square 144, while in FIG. 52 four additional right isosceles triangles 145, 146, 147 and 148 can be formed into a larger square 150.

Figure 50:
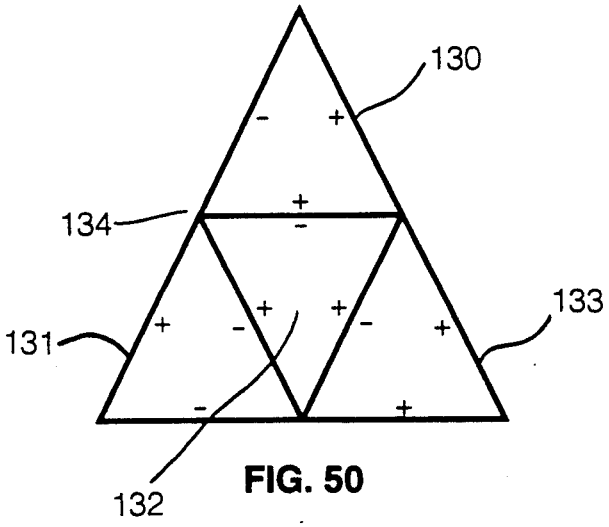
FIG. 50 illustrates the construction of one large planar triangle from four smaller triangles.
Figure 51:
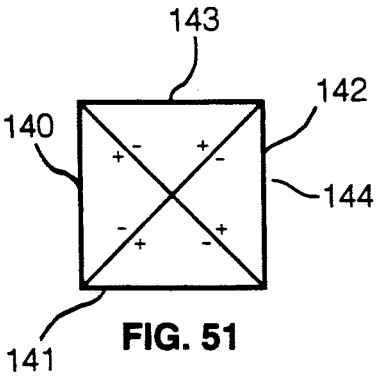
FIG. 51 illustrates the construction of one large planar square from four smaller triangles.
Figure 52:
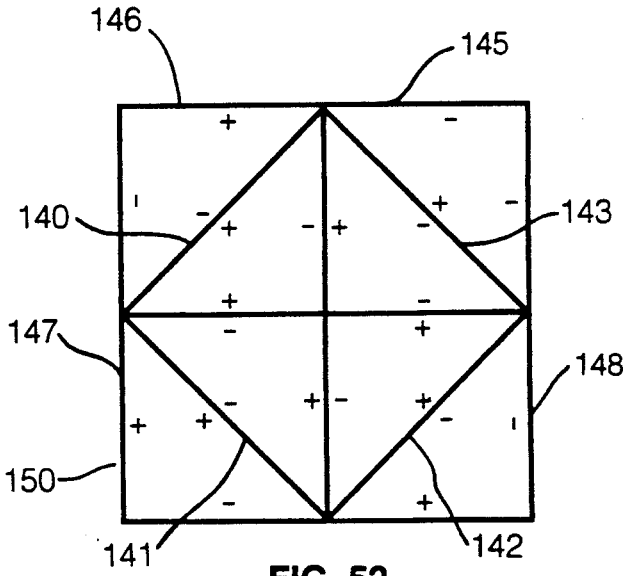
FIG. 52 illustrates the construction of one large planar square from eight smaller triangles.

One advantage to this technique is to create two frequency planar shapes having both plus and minus connectors along the sides thereof, as seen in FIGS. 50 through 52. Such an arrangement effectively eliminates the need for complementary pieces.

References to 77, 78, 79, and 80 have been made to exemplify the connector configurations on the various edges of individual construction pieces, and are not intended to refer to any particular construction piece.

As an added feature of the present invention, all planar construction pieces having standard connector sets attached thereto may be formed of a first color, while all connector pieces having expanded connector sets would be formed of a second color. In this fashion, it would be possible to readily distinguish among equilateral triangles having either standard or expanded connector sets thereon. In addition, other planar pieces, such as the squares, diamonds, octagons, pentagons, hexagons can be fashioned using colors different than those used for the triangular shapes, both for purposes of aesthetics and for ready identification of the configuration of the particular connector sets attached to the individual pieces.

Figure 29:
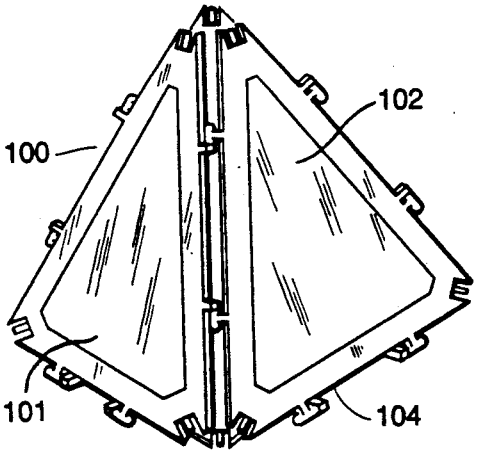
FIG. 29 is a perspective view of four triangular construction elements interconnected to form a tetrahedron.

FIG. 29 illustrates a tetrahedron 100 formed from equilateral triangular pieces 101, 102, 103 (not shown) and 104.

Figure 32:
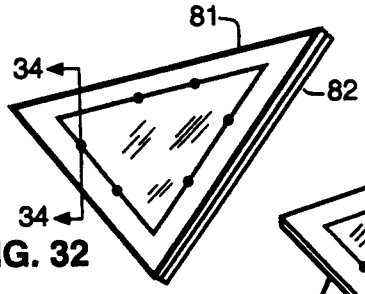
FIG. 32 is a perspective view of a pair of planar construction elements joined in parallel face-to-face and edge-to-edge relationship.
Figure 33:
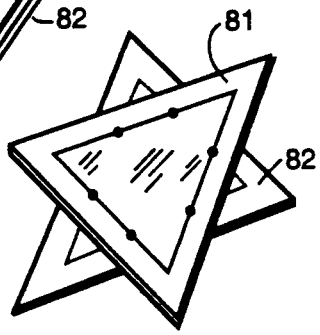
FIG. 33 is a view of the elements of FIG. 32 arranged in a skewed face-to-face fashion.
Figure 34:
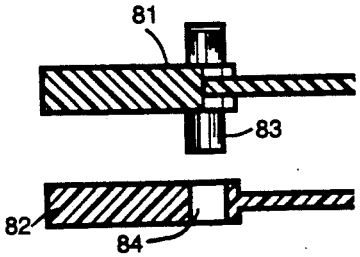
FIG. 34 is a view along 34—34 of FIG. 32 illustrating the pins and sockets used to effect face-to-face connection.

Referring now to FIGS. 32 and 33, there is therein shown a pair of planar construction pieces 81 and 82 arranged in face-to-face relationship. FIG. 32 illustrates identical shapes, corresponding faces and corresponding edges in parallel relationship, while FIG. 33 illustrates the same shapes in parallel face-to-face relationship, but with corresponding edges "skewed" or non-parallel. FIG. 34 is a disassembled view along line 34—34 of FIG. 32 illustrating the placement within planar shapes 81 and 82 of connecting pins such as that typified by 83, and the formation therein of pin sockets, such as that typified by 84 within which a corresponding pin may be press-fit to hold construction piece 81 to construction piece 82. It is contemplated that an array of such pins and pin sockets be formed on each construction piece, with the array having the same dimensional characteristics and same geometric layout on each piece to enable face-to-face interconnection. In one preferred embodiment certain construction pieces have pin sockets only formed thereon, while other construction pieces have correspondingly positioned pins embedded therein. The array of pins and pin sockets is selected to allow a variety of face-to-face connections, e.g., with one shape turned or rotated with respect to its underlying partner.

Figure 28:
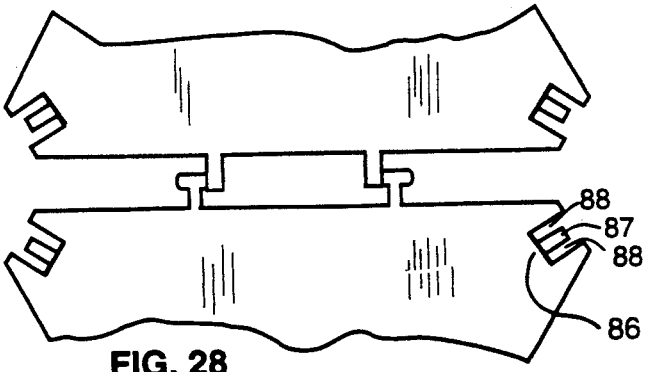
FIG. 28 is a partial plan view illustrating the interconnection of one standard plus connector set with a mating standard minus connector set resulting in the formation of two two-part hinges and the slotting arrangement at each apex.

FIG. 35 is a perspective view of a connecting pipe 85 use to effect lateral and apical interconnection of planar construction pieces to form two- and three-dimensional open structures. As seen variously throughout in FIGS. 1–12, and in FIG. 28 each planar construction piece has a plurality of mounting sites formed thereon, such as that typified by 86 of FIGS. 1 and 26. Mounting site 86, in a preferred embodiment, comprises a tongue 87 defined by the removal of material from piece 10 to form slots 88. The diameter of tongue 87 is selected to allow the engagement of pipe 85 in a friction fit.

FIG. 36 illustrates a flexible connecting ball 89 which may be used in lieu of pipe 85 by press-fitting apices of selected construction pieces into the surface of the ball.

FIG. 37 is a partial perspective view of two construction pieces, such as shown in FIG. 1, with the apices thereof joined by flexible connecting pipe 85. Such mounting sites can be positioned where desired depending upon the geometric shape of the construction pieces involved. For example, in FIG. 9, mounting sites 86 are formed at the corners of square 42 and may also be formed laterally therealong, if desired.

The interconnectability of the construction pieces of the present invention to form various planar and three-dimensional configurations is shown in FIGS. 29, 31 and 38 through 52.

In FIG. 38, the numeral 105 indicates a two dimensional pattern composed of six equilateral triangles 106 shown in FIG. 1 and six hexagonal shapes 107 as shown in FIG. 10.

Figure 2:
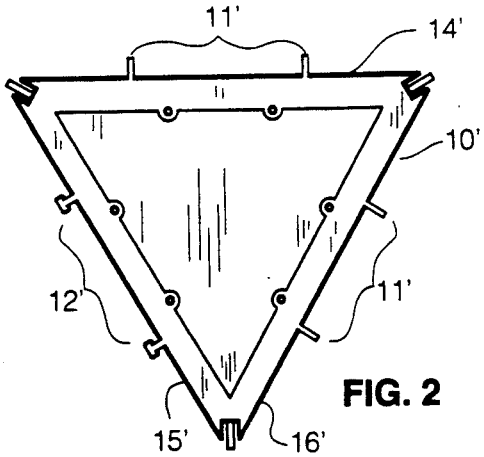
FIG. 2 is a plan view of a piece complementary to that of FIG. 1 having one plus and two minus connector sets.

In FIG. 39, the numeral 108 indicates a concave cubaoctahedron comprised of four tetrahedrons 109 formed from triangular pieces of the type shown in FIGS. 13 and 14 double-bonded to four additional tetrahedrons made from triangles of the type shown in FIGS. 1 and 2.

FIGS. 40 and 41 show a double bonded flexibly banded array consisting of one central octahedron 110 and eight tetrahedrons 111 held together by flexible bands 112.

FIGS. 42 and 43 illustrates a single bonded array held together with flexible bands 113 and balls 114 consisting of one central octahedron 115 surrounded by eight triple bonded tetrahedrons to form four composite polyhedrons 116.

Figure 44:
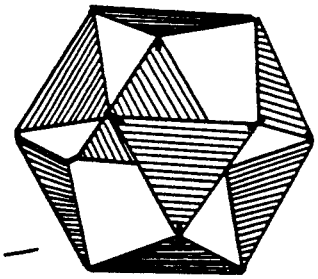
FIG. 44 is an open-faced cubaoctrahedron consisting of eight equilateral triangles joined apex-to-apex with flexible pipes.
Figure 45:
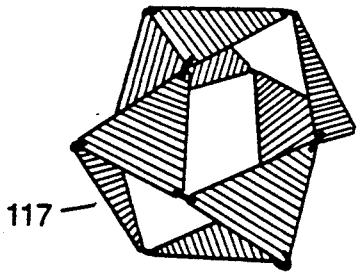
FIGS. 45 and 46 illustrate intermediate states of collapse of the construction shown in FIG. 44.
Figure 46:
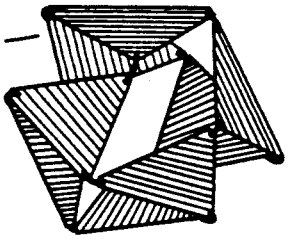
Figure 47:
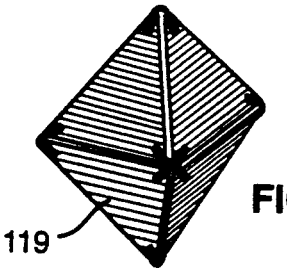
FIG. 47 shows the final collapsed state of the configuration of FIG. 44, i.e., octahedron

FIG. 44 is an open cuboctahedron 117 apically joined with flexible tubing consisting of eight equilateral triangles and connecting pipes. FIGS. 45, 46 and 47 show how construction 117 flexibly joined construction can be collapsed into an octahedron 119.

Figure 48:
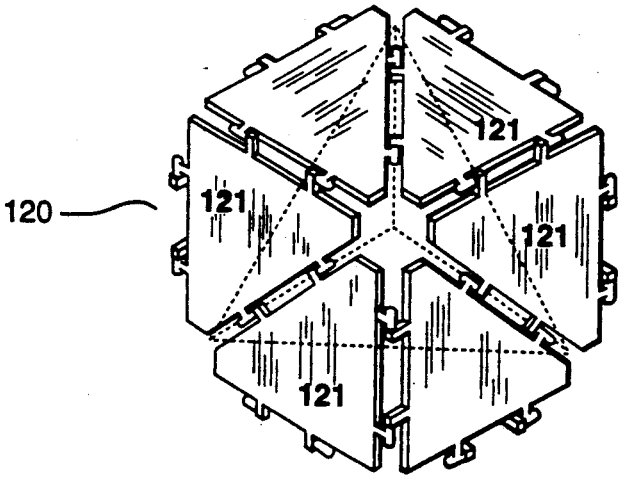
FIG. 48 is a cube formed from one central, doubly-bonded tetrahedron surrounded by four smaller, triply-bonded tetrahedrons.

FIG. 48 is a cube 120 formed by mounting four small tetrahedrons 121 onto one central equilateral tetrahedron. The four small tetras are each formed with three right isosceles triangles of the type shown in FIGS. 3 and 4. The central tetra is formed from four equilateral triangles of the type shown in FIGS. 11 and 12. Each face of the central tetra is hinged to and becomes the base of one of the small tetras. This is accomplished by four-way hinging along all edges of the large central tetra.

Figure 49:
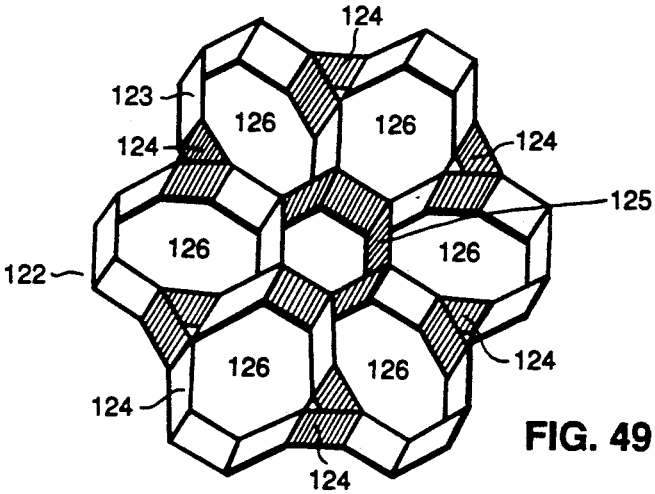
FIG. 49 is a pattern of doubly-and triply-hinged squares arranged to form prisms.

FIG. 49 is a symmetrical pattern 122 of prisms made up of two and three way interconnected squares 123. The three way interconnected prisms consist of six triangular prisms 124 and one hexagonal prism 125 while the linking two way interconnected squares complete the pattern forming six octagonal prisms 126. All linkages from triangular prisms to pentagonal and hexagonal prisms are three way connections formed with group two squares while the triangular prisms are formed from group one squares.

While the foregoing has presented certain preferred embodiments of the present invention, it is to be understood that these embodiments are presented by way of example only. It is expected that others skilled in the art will perceive variations which, while differing from the foregoing, do not depart from the spirit and scope of the invention as herein described and claimed, and the examples contained herein are not intended to limit the scope of the invention.

What is claimed is:

1. A geometric toy construction system, said system comprising:

first and second groups of substantially flat, substantially planar construction pieces, each of said first-group and second-group construction pieces terminating at three or more straight edges;

means formed on said edges for selectively connecting and disconnecting said first-group pieces one to another, said second-group pieces one to another, and said first-group pieces to said second-group pieces, said connecting means including one or more pairs of arms integral with and extending outwardly from any one of said construction pieces, each of said arms having a body generally perpendicular to one of said construction pieces, said body terminating in a pair of protuberances extending perpendicularly from said body to define each of said arms as generally T-shaped, said connecting means further including one or more pairs of posts integral with and extending outwardly from and generally perpendicular to any one of said construction pieces, each of said posts having at least one socket formed thereon sized to fit one said protuberance in a rotatable fit, a pair of said arms positioned symmetrically about the center point of any said edge identified as a "plus connector set", and a pair of said posts positioned symmetrically about the center point of any of said edges identified as a "minus connector set", each of said edges of said first-group pieces having either a first plus connector set or a first minus connector set formed thereon, each of said edges of said second-group pieces having either second and third plus connector sets, or second and third minus connector sets formed thereon, the arms in said first plus connector set are a third standard distance apart, the posts in said first minus connector set are a second standard distance apart, the arms in said second plus connector set are a first standard distance apart, the posts in said second minus connector set are a fourth standard distance apart, the arms in said third plus connector set are a fifth standard distance apart, the minus posts in said third minus connector set are a sixth standard distance apart, said first, second, third, fourth, fifth and sixth standard distances increase progressively in length from said first to said sixth, said first, second, third, fourth, fifth and sixth standard distances being selected to enable the interconnection of a first plus connector set with a first minus connector set, a second plus connector set with a first minus connector set, a first plus connector set with a second minus connector set, and a third plus connector set with a third minus connector set, thereby allowing the interconnection of said first-group and second-group construction pieces about a common axis.

2. The construction system of claim 1 wherein each of said posts has a pair of said sockets formed thereon on opposite sides thereof.

3. The construction system of claim 1 wherein said hexagon has a plus connector set formed on a first edge thereof, a plus connector set formed on a second edge adjacent to said first edge, a minus connector set formed on a third edge adjacent to said second edge, a plus connector set formed on a fourth edge adjacent to said third edge, a minus connector set formed on a fifth edge adjacent to said fourth edge and a minus connector set formed on a sixth edge adjacent to said fifth edge and said first edge.

4. The construction system of claim 1 wherein said construction system pieces are each triangular and have at least one plus connector set formed on two edges thereof and at least one minus connector set formed on the remaining edge thereof.

5. The construction system of claim 1 wherein said construction pieces are each triangular and have at least one minus connector set formed along two of the edges thereof and at least one plus connector set formed on the remaining edge thereof.

6. The construction system of claim 1 wherein one of said construction pieces is a parallelagram and has at least one plus connector set formed along each of a pair of opposing edges thereof and at least one minus connector set formed along each of the remaining pair of opposed edges thereof.

7. The construction system of claim 6 wherein said parallelogram is a square.

8. The construction system of claim 2 wherein each said connecting means is centered on each of said edges.

9. The construction system of claim 1 wherein one of said construction pieces is a pentagon.

10. The construction system of claim 9 wherein said pentagon has a plus connector set formed on a first edge thereof, a plus connector set formed on a second edge adjacent to said first edge, a minus connector set formed on a third edge adjacent to said second edge, a plus connector set formed on a fourth edge adjacent to said third edge and a minus connector set formed on a fifth edge adjacent to said fourth edge and said first edge.

11. The construction system of claim 9 wherein said pentagon has a plus connector set formed on a first edge thereof, a minus connector set formed on a second edge adjacent to said first edge, a minus connector set formed on a third edge adjacent to said second edge, a plus connector set formed on a fourth edge adjacent to said third edge and a minus connector set formed on a fifth edge adjacent to said fourth edge and said first edge.

12. The construction system of claim 1 wherein one of said construction pieces is a hexagon.

13. The construction system of claim 12 wherein said hexagon has a minus connector set formed on a first edge thereof, a minus connector set formed on a second edge adjacent to said first edge, a plus connector set formed on a third edge adjacent to said second edge, a minus connector set formed on a fourth edge adjacent to said third edge, a plus connector set formed on a fifth edge adjacent to said fourth edge and a plus connector set formed on a sixth edge adjacent to said fifth edge and said first edge.

14. The construction system of claim 1 wherein said connecting means further includes at least one connecting site formed on one edge of one of said construction pieces, each said connecting site including a central tongue formed on said edge, or at the intersection of two such edges and a pair of slots flanking said tongue and extending generally parallel thereto.

15. The construction system of claim 1 whereby one said site is formed at at least one corner of each of said construction pieces.

16. The construction system of claim 14 wherein said connecting means further includes a flexible connecting pipe, the inside diameter of which is substantially equal to the outside diameter of said tongue whereby said pipe and said tongue may be frictionally interengaged.

17. The construction system of claim 14 wherein said connecting means further includes one or more elastic band securable at and between selected of said connecting sites.

18. The construction system of claim 17 whereby said elastic bands are engageable within said slots to resiliently retain selected of said construction system pieces together.

19. The construction system of claim 14 wherein said connecting means further includes a pliable ball member into which said tongues may be removably inserted.

20. The construction system of claim 1 wherein at least one of said edges is a selected, standard length.

21. The construction system of claim 1 wherein said first standard distance is less than said second standard distance whereby, when interengaged, the posts of said first minus connector set are intermediate the arms of said first plus connector set.

22. The construction system of claim 1 wherein selected of said construction pieces are formed in a selected color to identify the standard distances of said connector means.

23. The construction system of claim 9 wherein said pentagon has a minus connector set formed on a first edge thereof, a plus connector set formed on a second edge adjacent to said first edge, a plus connector set formed on a third edge adjacent to said second edge, a minus connector set formed on a fourth edge adjacent to said third edge and a plus connector set formed on a fifth edge adjacent to said fourth edge and said first edge.

24. A geometric toy construction system, said system comprising:

first and second groups of substantially flat, substantially planar construction pieces, each of said first-group and second-group construction pieces terminating at three or more straight edges;

means formed on said edges for selectively connecting and disconnection said first-group pieces one to another, said second-group pieces one to another, and said first-group pieces to said second-group pieces, said connecting means including one or more pairs of arms integral with and extending outwardly from any one of said construction pieces, each of said arms having a body generally perpendicular to one of said construction pieces, said body terminating in a pair of protuberances extending perpendicularly from said body to define each of said arms as generally T-shaped, said connecting means further including one or more pairs of posts integral with and extending outwardly for and generally perpendicular to any one of said construction pieces, each of said posts having at least one socket formed thereon sized to fit one said protuberance in a rotatable fit, a pair of said arms centered on any of said edges identified as a "plus connector set", and a pair of said posts centered on any of said edges identified as a "minus connector set", each of said edges of said first-group pieces having either a first plus connector set or a first minus connector set formed thereon, each of said edges of said second-group pieces having either second and third plus connector sets, or second and third minus connector sets formed thereon, said connector sets spaced apart to allow the interconnection of said plus and minus connectors to thereby allow the interconnection of said construction pieces with one another and the rotation of said interconnected construction pieces about a common axis.

25. The construction of claim 24 wherein:

the arms in said first plus connector set are a third standard distance apart, the posts in said first minus connector set are a second standard distance apart, the arms in said second plus connector set are a first standard distance apart, the posts in said second minus connector set are a fourth standard distance apart, the arms in said third plus connector set are a fifth standard distance apart, the posts in said third minus connector set are a sixth standard distance apart, said first, second, third, fourth, fifth and sixth standard distances being selected to enable the interconnection of a first plus connector set with a first minus connector set, a second plus connector set with a first minus connector set, a first plus connector set with a second minus connector set, and a third plus connector set with a third minus connector set, thereby allowing the interconnection of said first-group and second-group construction pieces about said common axis.

26. The construction of claim 25 wherein said first, second, third, fourth, fifth and sixth standard distances increase progressively in length from said first to said sixth.

* * * * *